US006070616A

United States Patent [19]

Beck et al.

[11] Patent Number: 6,070,616

[45] Date of Patent: Jun. 6, 2000

[54] PROCESS FOR MOUNTING LUGS AND/OR PROJECTIONS ON A THIN METAL SHEET AND A THIN METAL SHEET HAVING LUGS AND/OR PROJECTIONS AS WELL AS A RECTANGULAR TUBE MADE OF THIN METAL SHEETS

[75] Inventors: Claus Beck, Esslingen; Jürgen Hägele, Stuttgart, both of Germany

[73] Assignee: Behr GmbH & Co., Stuttgart, Germany

[21] Appl. No.: 08/996,210

[22] Filed: Dec. 22, 1997

[30] Foreign Application Priority Data

Dec. 24, 1996 [DE] Germany ..... 196 54 367

[51] Int. Cl.[7] ..... F15D 1/04

[52] U.S. Cl. ..... 138/38; 138/39; 138/177; 138/DIG. 4; 138/DIG. 11

[58] Field of Search ..... 138/177, 38, 39, 138/DIG. 4, DIG. 11; 29/DIG. 37; 366/336, 337, 338, 340

[56] References Cited

U.S. PATENT DOCUMENTS

| | | | |
|---|---|---|---|
| 2,016,720 | 10/1935 | Krause | 138/58 |
| 2,250,542 | 7/1941 | Lodge . | |
| 2,252,045 | 8/1941 | Spanner | 138/38 |
| 2,627,283 | 2/1953 | Przyborowski | 138/38 |
| 2,634,759 | 4/1953 | Twickler | 138/38 |
| 2,813,708 | 11/1957 | Frey | 138/39 |
| 3,016,921 | 1/1962 | Tadewald | 138/38 |
| 4,283,824 | 8/1981 | Schatz et al. | 138/38 |
| 4,314,587 | 2/1982 | Hackett | 138/38 |
| 4,899,812 | 2/1990 | Altoz | 138/38 |
| 5,628,447 | 5/1997 | Ziemek | 138/38 |
| 5,803,162 | 9/1998 | Karbach et al. | 165/109.1 |
| 5,833,389 | 11/1998 | Sirovich et al. | 138/39 |

FOREIGN PATENT DOCUMENTS

| | | |
|---|---|---|
| 1 577 021 | 1/1970 | Germany . |
| 1 527 970 | 11/1971 | Germany . |
| 31 44 570 | 7/1983 | Germany . |
| 6-106287 | 4/1994 | Japan . |

*Primary Examiner*—James F. Hook
*Attorney, Agent, or Firm*—Evenson, McKeown, Edwards & Lenahan, P.L.L.C.

[57] ABSTRACT

A process for mounting lugs or projections on a thin metal sheet, by forming the lugs and/or projections out of the thin metal sheet by way of massive forming. Such a thin metal sheet in the form of a thin sheet metal strip is used preferably for forming rectangular tubes for an exhaust gas heat transfer device which, for guiding the exhaust gas, is provided with a bundle of these rectangular tubes.

11 Claims, 2 Drawing Sheets

PROCESS FOR MOUNTING LUGS AND/OR PROJECTIONS ON A THIN METAL SHEET AND A THIN METAL SHEET HAVING LUGS AND/OR PROJECTIONS AS WELL AS A RECTANGULAR TUBE MADE OF THIN METAL SHEETS

BACKGROUND AND SUMMARY OF THE INVENTION

This application claims the priority of German patent application 196 54 367.3, the disclosure of which is expressly incorporated by reference herein.

The invention relates to a process for mounting lugs and/or projections on a thin metal sheet, particularly on a thin sheet metal strip, which project essentially perpendicularly from the base of the thin metal sheet and have a height which is higher than the metal sheet thickness, as well as to a thin metal sheet produced accordingly and to a rectangular tube for a heat transfer device produced of two thin metal sheets.

In commonly assigned German patent application P 195 40 683.4 and counterpart U.S. patent application Ser. No. 08/743,002, the disclosures of which are expressly incorporated by reference herein, lugs are mounted in pairs on thin metal sheets and diverge in a V-shape in the flow direction. These lugs extend to approximately a quarter or a third of the height of the rectangular tube so that they have a height which is clearly higher than the sheet thickness. In the above-referenced patent application, these lugs are provided particularly as inserts which are mounted on the thin metal sheets when the rectangular tubes are joined or before.

It is an object of the invention to provide a process of the initially mentioned type which can be implemented in an economical manner.

This and other objects have been achieved in that the lugs and/or projections are formed out of the metal sheet by means of massive forming, for example extrusion.

The process according to the invention has the advantage that the lugs and/or projections cannot only be mounted on a thin metal sheet or thin sheet metal strip in a simple manner and at reasonable cost but that also the lugs and/or projections are massive parts which internally adjoin the thin metal sheet without gaps or the like. As a result, no points are formed which are subject to corrosion.

As a further development of the invention, in the area of the lugs and/or projections, the thin metal sheet is loaded by means of a top die or a bottom die in a plane manner beyond its yield point, in which case a portion of the sheet metal material is pressed into one or several recesses of the bottom die and/or top die which, as negative molds, correspond to the lugs and/or projections to be mounted. As a result, lugs and/or projections can easily be mounted on the thin metal sheet while maintaining relatively narrow tolerances.

An advantageous application of the thin metal sheets and particularly of the thin sheet metal strips produced according to the process of the invention is the fact that a rectangular tube for a heat transfer device, particularly for an exhaust gas heat transfer device, is assembled of two U-shaped thin sheet metal shells, in which case lugs arranged in pairs project at least from the bottom of one of the thin sheet metal shells toward the inside, diverge in a V-shape in the flow direction and by means of massive forming are molded out of the bottom of at least one of the thin sheet metal shells.

Other objects, advantages and novel features of the present invention will become apparent from the following detailed description of the invention when considered in conjunction with the accompanying drawings.

DETAILED DESCRIPTION OF THE DRAWINGS

Figure 1:
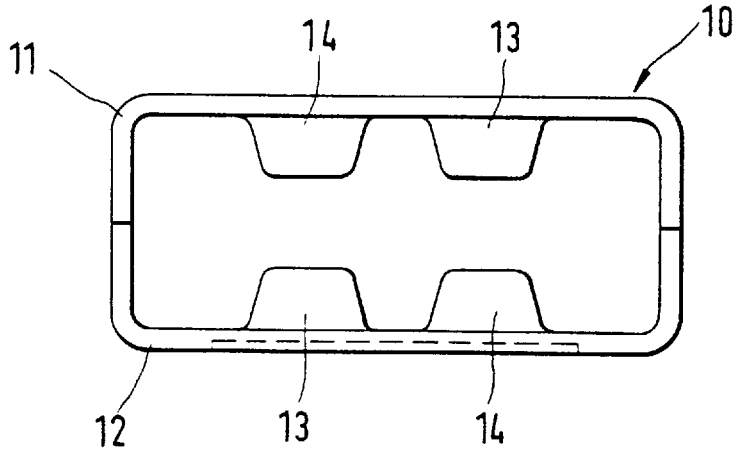
FIG. 1 is a frontal view of a rectangular tube for an exhaust gas heat transfer device which is provided with lugs molded by means of massive forming from the bottom of the thin sheet metal shells according to a preferred embodiment of the present invention.
Figure 2:
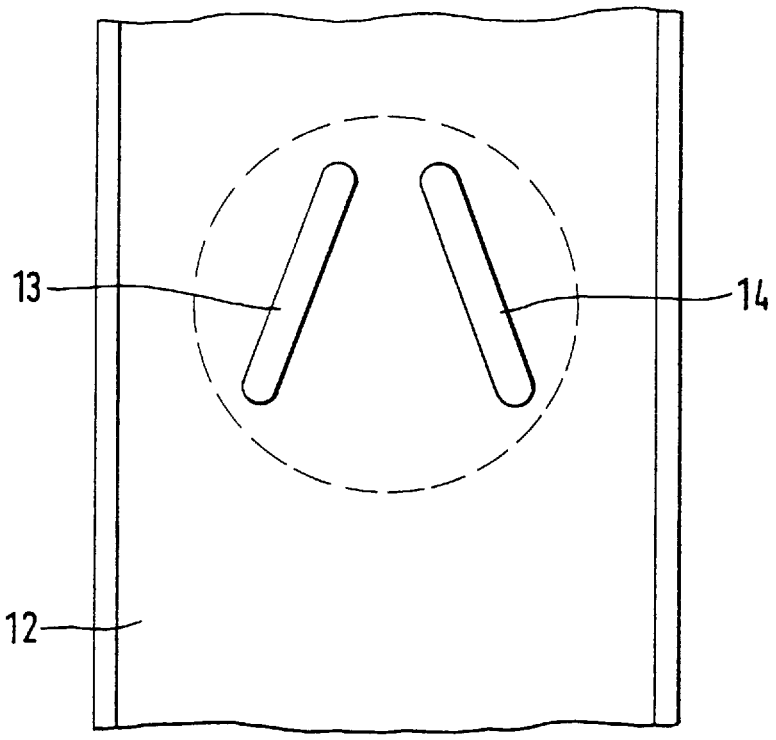
FIG. 2 is a plan view of a sheet metal shell in the area of two lugs.

The rectangular tube 10 illustrated in FIGS. 1 and 2, which is shown at approximately four times its normal size, is intended for use in a heat transfer device and particularly an exhaust gas heat transfer device. From a plurality of rectangular tubes 10 of this type, a bundle of tubes is formed which is intended for guiding exhaust gas. The ends of the tube bundles are arranged in a gastight manner in one tube bottom respectively, in which case, together with a jacket surrounding the tube bundle, the tube bottoms form a housing for guiding a liquid coolant. Between the two tube bottoms, this housing is provided with an inlet and an outlet for the liquid coolant. An exhaust gas heat exchanger of this type is disclosed in German Patent Application P 195 40 683.4, and counterpart U.S. patent application Ser. No. 08/743,002.

The rectangular tube 10 is composed of two U-shaped thin sheet metal shells 11, 12 which are tightly connected, particularly welded, to one another on their webs. Lugs 13, 14, which extend approximately along a fourth to a third of the height of the rectangular tube, project from the bottoms of the two thin sheet metal sheets 11, 12 into the interior of the rectangular tube 10. The lugs 13, 14 are in each case arranged in pairs symmetrically to the longitudinal center of the rectangular tube 10. They diverge in a V-shape in the flow direction of the gas to be guided, their ends facing the flow direction maintaining a distance from one another. The lugs 13, 14 arranged in pairs are repeated along the length of the rectangular tube 10 in a regular spacing. In this case, the thin sheet metal shells 11, 12 are arranged offset with respect to one another such that the lugs 13, 14 of the bottoms of the thin sheet metal shell 11 and of the thin sheet metal shell 12 are arranged to be offset with respect to one another in the longitudinal direction.

The lugs 13, 14 are formed out of the bottoms of the thin sheet metal shells 11, 12 by means of massive forming and particularly by means of extruding. For this purpose, the thin sheet metal strips, which are later formed into thin sheet metal half shells 11, 12, are loaded between a bottom die and a top die in a plane manner with pressure such that the yield limit of the sheet metal material is exceeded and a portion of the thin sheet metal material flows into slots of a bottom die (or of the top die) which determine the shape of the lugs 13, 14. In the embodiments illustrated in FIGS. 1 and 2, the sheet metal strips are loaded by means of a circular surface which surrounds the two lugs 13, 14. However, other loading surfaces may also be provided, such as square or rectangular surfaces or surfaces which are adapted to the contour of the lugs 13, 14 to be formed. The thin sheet metal strips, which have a sheet thickness of no more than 1.0 mm, are compressed by means of extruding to approximately 70% to approximately 50% of their original sheet thickness, resulting in lugs 13, 14 of a height which may easily amount to 1.5 times the original sheet thickness.

Figure 3:
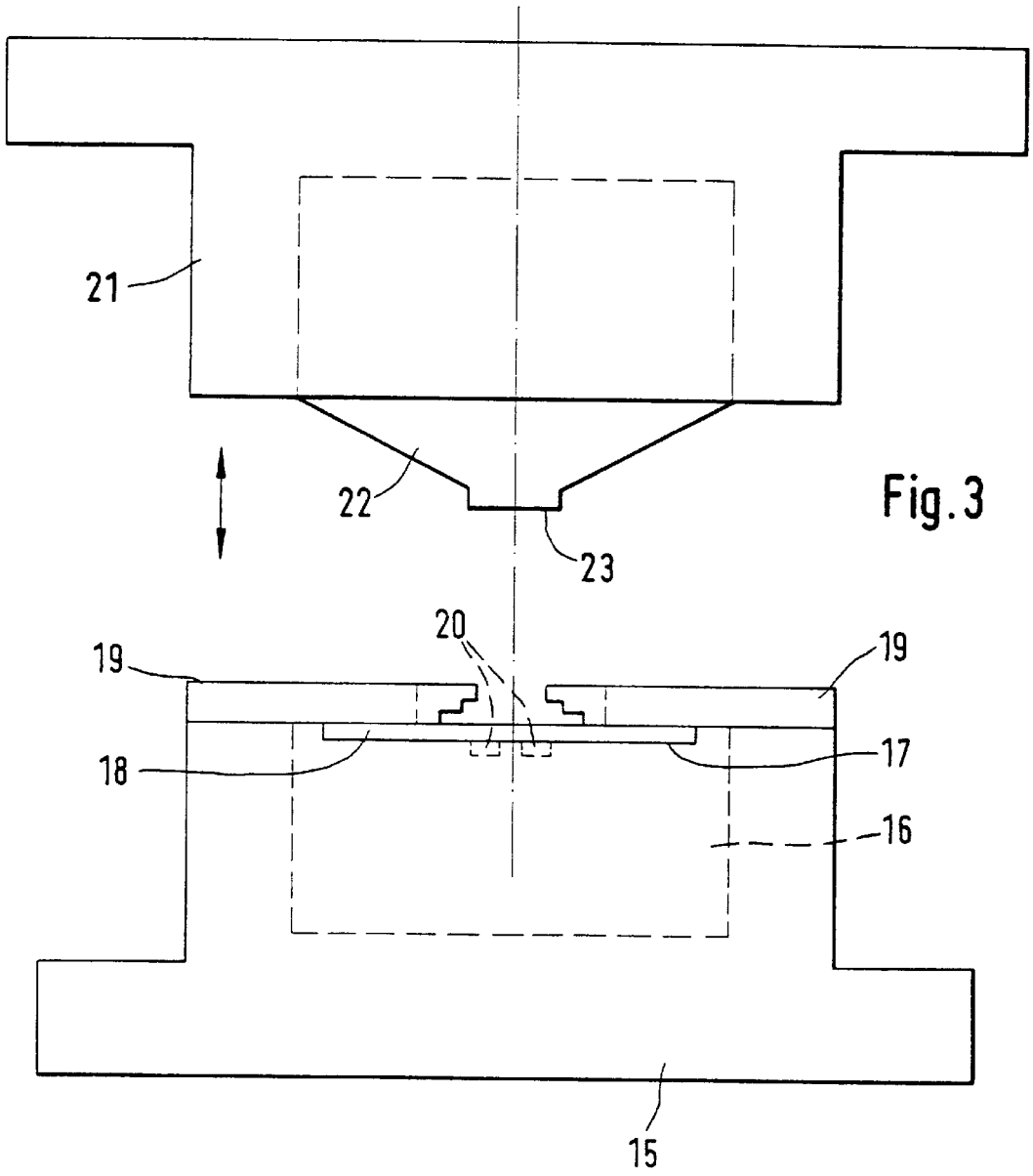
FIG. 3 is a view of a device for carrying out the process according to the present invention.

FIG. 3 is a schematic view of a device by means of which the massive forming for creating the lugs can be carried out. The device has a bottom part 15 in which a bottom die 16 is arranged. The bottom die 16 has a recess 17 into which a thin sheet metal strip 18 is pushed. The thin sheet metal strip 18 is held in the recess 17 by means of guides 19 mounted on the bottom part 15. In the bottom die 16, slot-shaped recesses 20 are provided which are used as negative molds for the lugs 13, 14 to be formed.

In a top part 21, which can be applied to the bottom part 15 while applying a pressure force, a top die 22 is held which can be applied to the sheet metal strip 18 between the guides 19, in which case it covers the area of the recesses 20 in a plane manner. For this purpose, the top die 22 has a plane die surface 23 which is in parallel to the thin metal sheet 18 and which, in a plane manner, covers the area of the recesses 20 of the bottom die 16 in a sufficient size. By means of its die surface 23, the top die 22 is pressed with sufficient force into the thin sheet metal strip 18 so that the yield limit of the sheet metal material is exceeded. A portion of the sheet metal material will then flow into the recesses 20 and in the process form the lugs 13, 14 which are illustrated in FIGS. 1 and 2. In this case, in the area of the die surface 23, the thin metal sheet is compressed to approximately 70% to approximately 50% of the original sheet thickness. The indentation depth depends on the height of the lugs to be formed. Expediently, the indentation depth of the die surface 23 of the top die 22 is limited by a depth stop. The recesses 20 may be open slots or have a depth which is larger than the desired height of the lugs. The height of the lugs is determined by the indentation depth with which the die surface 23 is pressed into the thin metal sheet 18. It should be noted that, during extrusion, the lubricants are used which are customary for extruding in order to improve the stamping time of the tool.

The extrusion can be carried in a cold state. If the extrusion takes place in a semicold state, for example, at up to 600° C., or in the warm state, for example, at up to 1,200° C., the flowability of the sheet metal material will increase so that lower forming forces are required. A No. 1.4539 steel, for example, was found to be useful as the material for the thin sheet metal strip.

By means of the device illustrated in FIG. 3, the pairs of lugs 13, 14 can be formed on the sheet metal strips 18 in a timed manner in that the thin metal sheet 18 is advanced in a timed manner and the extrusion operation is carried out by the application of the top die 22 also in a timed manner. However, it is also possible to carry out a similar extrusion by rolling the thin sheet metal strip. In this case, it may also be provided that a center strip, in which the lugs 13, 14 are shaped by massive forming, is continuously extruded and therefore compressed while, nevertheless, the lugs are formed only at regular intervals.

In a modified embodiment, a bottom die 16 is provided with a plane support surface while recesses corresponding to the recesses 20 are provided in the top die 22 in the area of the die surface 23. However, the provision of the recesses 20 in the bottom die 16 has the advantage that the gas-carrying side of a tube formed of the sheet metal strips 18 has smooth interior walls with the exception of the lugs 13, 14 so that a deposition of solid particles or the like is avoided.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A rectangular tube for an exhaust gas heat transfer device, comprising two U-shaped thin sheet metal shells, lugs arranged in pairs projecting to the inside from the bottom of at least one of the thin sheet metal shells, said lugs diverging in a V-shape in a flow direction, wherein the lugs are formed by massive forming from the bottom of at least one of the thin sheet metal shells.

2. A rectangular tube for an exhaust gas heat transfer device according to claim 1, wherein said lugs in each of said pairs are arranged symmetrically to a longitudinal center of the rectangular tube and spaced at a distance therefrom.

3. A rectangular tube for an exhaust gas heat transfer device according to claim 2, wherein said lugs diverge in a flow direction, such that respective upstream ends of said pair of lugs are spaced at a first distance from each other, and such that respective downstream ends of said pair of lugs are spaced at a second distance from each other, said second distance being greater than said first distance.

4. A rectangular tube for an exhaust gas heat transfer device according to claim 1, wherein said lugs project essentially perpendicularly from said bottom and having a height which is greater than a thickness of said bottom.

5. A rectangular tube for an exhaust gas heat transfer device according to claim 1, wherein said lugs have a height which is in the range of a quarter to a third of the height of the rectangular tube.

6. A rectangular tube for an exhaust gas heat transfer device according to claim 1, wherein the thin metal shell is pressed in proximate said lugs to a thickness in the range of approximately 70% to approximately 50% of an original shell thickness.

7. A process for forming the rectangular tube for an exhaust gas heat transfer device according to claim 1, comprising:

massive forming said thin metal shell to form said lugs thereon projecting essentially perpendicularly from a base of the thin metal shell and having a height which is greater than a thickness of the metal shell.

8. A process according to claim 7, wherein said massive forming step is effected via a continuous rolling to produce said lugs.

9. A process according to claims 7, wherein in said massive forming act, the thin sheet metal shell is indented by means of extrusion in the area of said at least one of lugs and projections to a thickness in the range of approximately 70% to approximately 50% of an original thickness of the sheet metal shell.

10. A process according to claim 7, wherein said massive forming act is effected via a top die and a bottom die, one of said dies having recesses corresponding to said lugs, said massive forming act comprising loading the thin metal shell via the top die and the bottom die in a plane manner beyond a yield limit of the sheet metal shell material such that a portion of the metal shell material is pressed into said recesses to form said lugs.

11. A process according to claim 10, wherein said lugs are formed via a timed application of the top die and the bottom die and a timed advancement of the thin metal shell.

* * * * *